US005355931A

United States Patent [19]

Donahue et al.

[11] Patent Number: 5,355,931

[45] Date of Patent: Oct. 18, 1994

[54] METHOD OF EXPENDABLE PATTERN CASTING USING SAND WITH SPECIFIC THERMAL PROPERTIES

[75] Inventors: Raymond J. Donahue, Fond du Lac; Terrance M. Cleary, Allenton; William G. Hesterberg, Rosendale, all of Wis.; Terry C. Holmgren, Ishpeming, Mich.

[73] Assignee: Brunswick Corporation, Skokie, Ill.

[21] Appl. No.: 119,035

[22] Filed: Sep. 9, 1993

Related U.S. Application Data

[63] Continuation-in-part of Ser. No. 940,485, Sep. 4, 1992, abandoned.

[51] Int. Cl.[5] ..... B22C 7/02

[52] U.S. Cl. ..... 164/34; 164/529

[58] Field of Search ..... 164/34, 520, 529, 122

[56] References Cited

U.S. PATENT DOCUMENTS

| | | | |
|---|---|---|---|
| 3,333,579 | 8/1967 | Shockley . | |
| 3,536,123 | 10/1970 | Izumi | 164/114 |
| 4,113,473 | 9/1978 | Gauvry | 75/148 |
| 4,139,045 | 2/1979 | Vitt | 164/34 |
| 4,603,665 | 8/1986 | Hesterberg et al. | 123/195 |
| 4,693,292 | 9/1987 | Campbell | 164/34 |
| 4,711,287 | 12/1987 | Kuwabara et al. | 164/34 |
| 4,804,032 | 2/1989 | Wilkins | 164/34 |
| 4,821,694 | 4/1989 | Hesterberg et al. | 123/195 |
| 4,875,517 | 10/1989 | Donahue et al. | 164/34 |
| 4,902,475 | 2/1990 | Apelain et al. | 420/548 |
| 4,966,220 | 10/1990 | Hesterberg et al. | 164/34 |
| 4,969,428 | 11/1990 | Donahue et al. | 123/195 |
| 5,129,378 | 7/1992 | Donahue et al. | 123/193.4 |

OTHER PUBLICATIONS

Metals Handbook, 9th Ed., vol. 15, p. 233, Sep. 1988.

*Primary Examiner*—P. Austin Bradley
*Assistant Examiner*—Erik R. Puknys
*Attorney, Agent, or Firm*—Andrus, Seales, Starke & Sawall

[57] ABSTRACT

A method of producing dimensionally predictable metal castings utilizing an expendable polymeric foam pattern along with unbonded sand having specific thermal properties. The pattern, formed of a material such as polystyrene, has a configuration corresponding to that of the article to be cast. The pattern is placed with an outer flask and unbonded sand surrounds the pattern as well as filling the cavities in the pattern. The sand has a linear expansion of less than 1% from 0° C. to 1600° C., a heat diffusivity greater than 1500 $J/m^2/°K/S^{\frac{1}{2}}$, an AFS grain fineness number of 25 to 33, and an AFS base permeability number of 450 to 500. A molten metal, such as an aluminum alloy or a ferrous alloy, is fed into the mold in contact with the pattern causing the pattern to vaporize with the vapor being entrapped within the interstices of the sand while the molten metal fills the space initially occupied by the foam pattern to produce a cast article. The physical properties of the sand enable articles to be cast having more precise and predictable tolerances.

10 Claims, 14 Drawing Sheets

METHOD OF EXPENDABLE PATTERN CASTING USING SAND WITH SPECIFIC THERMAL PROPERTIES

This application is a continuation-in-part of application Ser. No. 07/940,485, filed Sep. 4, 1992, now abandoned.

BACKGROUND OF THE INVENTION

Expendable Pattern casting, also known as lost foam casting, is a known casting technique in which a pattern formed of an polymeric foam material, such as polystyrene or polymethylmethacrylate, is supported in a flask and surrounded by an unbonded particulate material, such as silica sand. When the molten metal contacts the pattern, the foam material decomposes with the products of decomposition passing into the interstices of the sand while the molten metal replaces the void formed by the expended foam material to produce a cast part which is identical in configuration to the pattern.

In the conventional expendable pattern casting process, the sand which surrounds the pattern and fills the cavities in the pattern is unbonded and free flowing and this differs from traditional sand casting processes, wherein the sand is utilized with various types of binders. However, after compaction, the unbonded sand density is generally higher than the density of molds made with bonded sand, and therefore the rigidity or stiffness of compacted unbonded sand is not deficient relative to bonded sand molds. Traditionally, silica sand has been used exclusively as the molding material in expendable pattern casting because it is readily available and inexpensive.

It has been recognized that a conventional expendable pattern casting process is only capable of matching the precision of green sand casting and has not been considered a precision sand casting process. This lack of precision for a process that uses metal molds to make the foam patterns, has been a drawback of the process.

In cast cylinder blocks for internal combustion engines, the axes of the cylinder bores must be maintained within a specific tolerance. After casting the cylinder bores are simultaneously machined by automated machining equipment. If the axes of the cylinder bores are not within the specified tolerance, the bores cannot be satisfactorily machined, with the result that the engine block must be scrapped.

In casting an engine block using an expendable foam casting process, the foam pattern contains a number of cylindrical bores or cavities and in the casting process, the bores are filled with the unbonded sand. The shrinkage of the molten metal on solidification can be accurately calculated, and thus the diameters of the cylindrical bores in the pattern are increased to reflect the shrinkage of the metal. However, if the sand contained within the bores does not accommodate the shrinkage of the molten metal and resists this shrinkage, an unpredictable metal shrinkage is obtained which causes a lack of precision in the cylinders of the cast engine block.

One skilled in the metal casting art does not expect the temperature of the sand to have a significant influence on the dimensional size of castings produced by any of the sand casting processes. The major reason for this oversight is because, except for the expendable pattern casting process which uses unbonded sand, sand casting processes employ bonded sand molds that are used at the semi-uncontrolled ambient temperatures seen on the foundry floor. The economics of achieving through-put in the foundry and the cost of carrying an unnecessarily high inventory of molds on the foundry floor, dictate that the bonded sand molds be used in some orderly just-in-time approach. As a result, it is not the practice of foundries to heat or to cool the sand molds in a separate "conditioning" or stabilizing area and there has been no recognition that the temperature of the sand mold has a significant effect on the dimensional size or tolerances of the resulting castings that are produced with the molds.

SUMMARY OF THE INVENTION

The invention is directed to a method of expendable pattern casting utilizing a sand molding material having specific physical properties to produce castings having more precise dimensions or tolerances. The invention has particular application to the casting of engine blocks for internal combustion engines.

In the method of the invention, a polymeric foam pattern is produced having a configuration corresponding to the article to be cast. The foam pattern is supported in a flask and an unbonded sand is fed into the flask, surrounding the pattern and filling the cavities in the pattern.

The sand has a heat diffusivity greater than 1500 $J/m^2/°K/s^{\frac{1}{2}}$, and a linear expansion from 0° C. to 1600° C. of less than 1%. Chromite sand, silicon carbide sand, olivine sand, and carbon sand have these properties and are examples of sands which can be utilized. In addition, the sand should have an AFS fineness number of 25 to 33, and an AFS base permeability number of 450 to 500. The AFS grain fineness number is a measure of average grain size, derived by calculation from the results of sieve analysis in which the sum of the products of fraction retained in each sieve is multiplied by the size of the preceding sieve. Most foundry sands fall within the range of 40 (coarse) to 220 (fine). Base permeability, expressed as an AFS permeability number, is the rate in milliliters per minute at which air will pass through the sand under a standard condition of pressure of 1 $gram/cm^2$ through a specimen 1 $cm^2$ in cross sectional area and 1 cm high.

When casting multiple parts, it is important to control the sand temperature within a specified range in order to obtain dimensionally stable or predictable cast parts. For example, with cylinder blocks for internal combustion engines, the sand in each casting operation should be maintained within a range of about ±10° F., while when casting other articles the temperature in each casting operation should be maintained within a range of ±20°0 F.

When the foam pattern is contacted by the molten metal, the pattern will decompose and the products of decomposition will be entrapped within the interstices of the unbonded sand while the metal will fill the space initially occupied by the foam pattern, thereby producing a cast article which corresponds in configuration to the foam pattern.

It has been discovered that the use of sand with specified thermal and physical properties, will result in dimensionally predictable metal castings.

As a further advantage, the use of sand with the above specified properties produces a more uniform shrinkage of the cast metal on solidification, resulting in a coefficient of variation of shrinkage of less than 45%, as compared to a coefficient of variation of shrinkage of about 50% when using silica sand. The reduction in the coefficient produces a more precisely dimensional casting.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
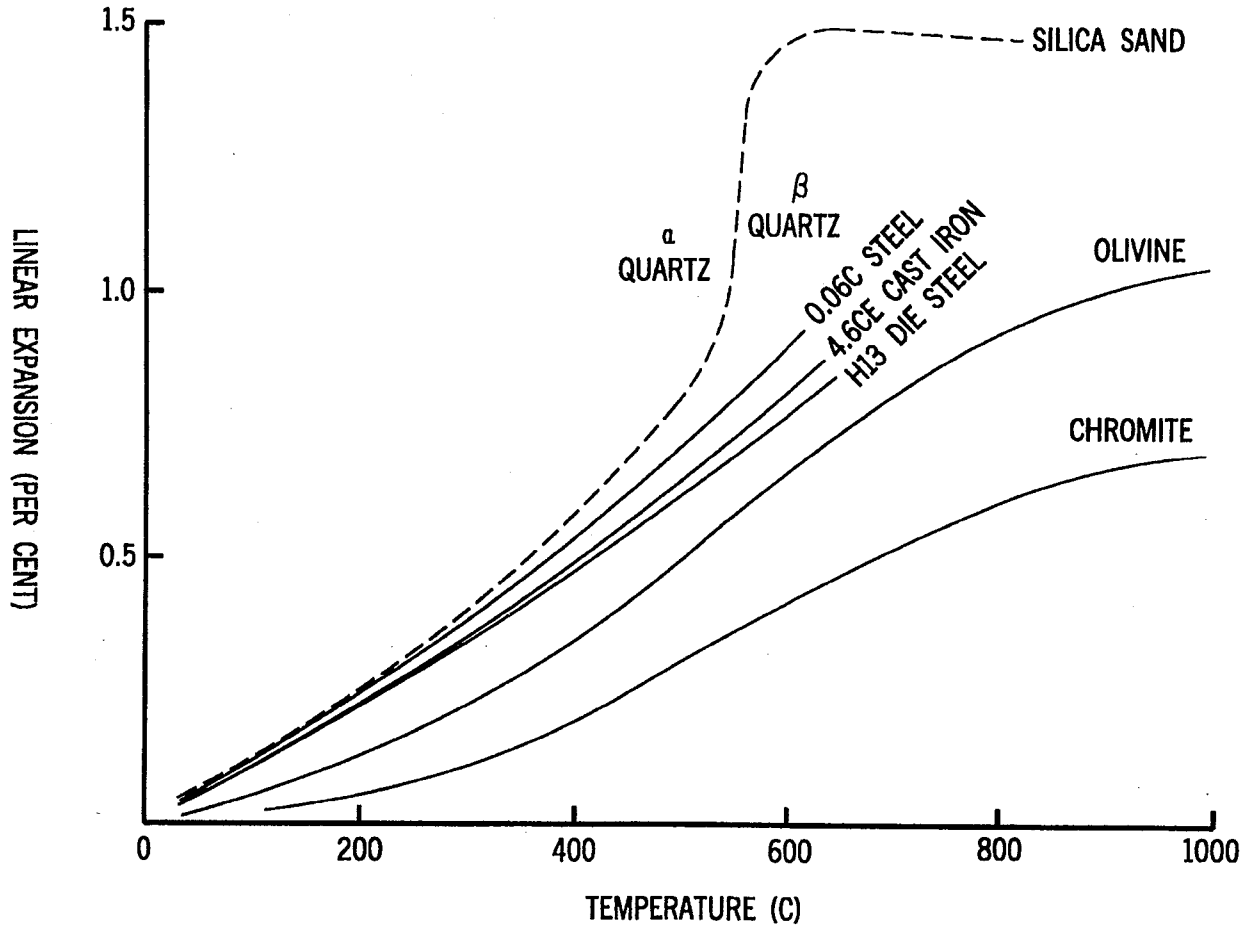
FIG. 1 is a graph showing the linear expansion of various sands with temperature.

The invention relates to a method of expendable pattern casting utilizing unbonded sand having specific physical and thermal properties as a molding material.

In carrying out the invention, a polymeric foam pattern is produced from a material such as polystyrene or polymethylmethacrylate to provide a pattern having a configuration corresponding to that of the article to be cast. The foam pattern itself is produced by conventional procedures using metal dies.

As in conventional expendable foam casting, the pattern can be coated with a porous ceramic material which acts to prevent a metal/sand reaction and facilitates cleaning of the cast metal part. The ceramic coating is normally applied by immersing the pattern in a bath of ceramic wash, draining the excess wash from the pattern and drying the wash to provide the porous ceramic coating.

The process of the invention can be used with any desired metal or alloy and has particular application in casting aluminum alloys, such as hypoeutectic or hypereutectic aluminum-silicon alloys, or ferrous metals, such as cast iron or steel. In general, the hypereutectic aluminum silicon alloys to be used in the invention contain by weight 12% to 30% silicon, 0.4% to 5.0% magnesium, up to 0.3% manganese, up to 1.4% iron, up to 5.0% copper, and the balance aluminum.

Specific examples of hypereutectic aluminum silicon alloys to be used are as follows in weight percent:

EXAMPLE 1

| | |
|---|---|
| Silicon | 16.90% |
| Iron | 0.92% |
| Copper | 0.14% |
| Manganese | 0.12% |
| Magnesium | 0.41% |
| Aluminum | 81.51% |

EXAMPLE 2

| | |
|---|---|
| Silicon | 20.10% |
| Iron | 0.20% |
| Copper | 0.33% |
| Manganese | 0.18% |
| Magnesium | 0.71% |
| Aluminum | 78.40% |

The hypoeutectic aluminum-silicon alloys to be used in the invention contain by weight less than 12% silicon, and one common sand casting alloy contains from 6.5% to 7.5% by weight of silicon, 0.25% to 0.45% by weight of magnesium, up to 0.6% iron, up to 0.2% copper, up to 0.25% titanium, up to 0.35% zinc, up to 0.35% manganese, and the balance aluminum. Another common hypoeutectic aluminum-silicon alloy that can be used in the invention contains from 5.5% to 6.5% by weight of silicon, from 3.0% to 4.0% by weight of copper, from 0.1% to 0.5% by weight of magnesium, up to 1.2% iron, up to 0.8% manganese, up to 0.5% nickel, up to 3.0% zinc, up to 0.25% titanium, and the balance aluminum.

Specific examples of hypoeutectic-aluminum silicon alloys to be used are as follows in weight percent:

EXAMPLE 3

| | |
|---|---|
| Silicon | 7.10% |
| Magnesium | 0.31% |
| Copper | 0.05% |
| Titanium | 0.05% |
| Zinc | 0.10% |
| Manganese | 0.05% |

-continued

| | |
|---|---|
| Aluminum | 92.21% |

EXAMPLE 4

| | |
|---|---|
| Silicon | 6.21% |
| Copper | 3.15% |
| Magnesium | 0.32% |
| Iron | 0.80% |
| Manganese | 0.51% |
| Nickel | 0.34% |
| Zinc | 1.02% |
| Titanium | 0.20% |
| Aluminum | 87.35% |

Traditionally, silica sand having a grain size of approximately 40 AFS, has been used as the molding material in expendable pattern casting due to the fact that silica sand is readily available and is inexpensive. Through the development of the invention, it has been discovered that the use of silica sand presents certain drawbacks when utilized in expendable pattern casting procedures that were heretofore unrecognized, and it has been further discovered that the unbonded sand molding material should have certain physical properties, not obtainable with silicon sand, in order to achieve precision castings.

It has been discovered that the physical properties of sand, particularly the thermal properties, greatly effect the precision of casting when using expendable foam patterns. To provide the improved precision in casting, the sand should have a heat diffusivity greater than 1500 $J/m^2/°K/s^{\frac{1}{2}}$, and a total linear expansion from 0° C. to 1600° C. of less than 1%. Chromite sand ($FeCr_2O_4$), silicon carbide sand, carbon sand, and olivine sand (a solid solution of forsterite, $Mg_2SiO_4$, and fayalite, $Fe_2SiO_4$) are examples of sands that have these physical properties.

The sand should also have an AFS grain fineness of 25 to 33 AFS and preferably about 31 AFS, an AFS permeability number of 450 to 500, and preferably about 475. The above specified grain size is more coarse than that traditionally used in expendable foam casting procedures. As previously noted, silica sand as used in the past in expendable foam casting has a grain size of about 40 AFS. Moreover, the sand, as used in the invention, has a tight or narrow particle size distribution with a minimum distribution of fine to coarse. This results in the permeability of the sand being substantially greater than the permeability of sand as customarily used in expendable foam casting processes, which normally has an AFS base permeability number of about 300.

A comparison of the physical properties of chromite sand, silicon carbide sand and silica sand are shown in the following table.

TABLE I

| | Silica Sand | Chromite Sand | Silicon Carbide Sand |
|---|---|---|---|
| Thermal conductivity (Watts/m/°K.) | 0.90–0.61 | 1.09 | 3.25 |
| Density ($Kg/m^3$) | 1500 | 2400 | 2000 |
| Specific heat (J/Kg/°K.) | 1130–1172 | 963 | 840 |
| Thermal diffusivity ($m^2/s \times 10^{-6}$) | 0.360–0.512 | 0.472 | 2.0 |
| Heat diffusivity ($J/m^2/°K./s^{\frac{1}{2}}$) | 1017–1258 | 1587 | 2340 |

The thermal conductivity of a material is the quantity of heat which flows per unit time through a unit area of a mass of the material of unit thickness when there is a difference of 1° in the temperatures across opposite faces of the mass. The time rate of change of the temperature, at any location is proportional to the instantaneous slope of temperature gradient. The proportionality constant is called the thermal diffusivity and is defined as the thermal conductivity divided by the volumetric heat capacity where the volumetric heat capacity is the heat per unit volume necessary to raise the temperature of the mass 1°.

The heat diffusivity, on the other hand, is a measure of the rate at which the mold can absorb heat and is the square root of the product of the thermal conductivity, the density and the specific heat. As such, heat diffusivity is directly related to solidification rate of the molten metal.

It has been found that the linear expansion of the sand with temperature is an important factor in providing precise castings, and the linear expansion of the sand should be less than 1% over a temperature range of 0° C. to 1600° C., and preferably less than 0.75%, over a temperature range of 0° C. to 700° C. FIG. 1 is a graph showing the change in linear expansion of silica sand, chromite sand and olivine sand with temperature. The curve of silica sand shows a substantial increase in expansion as the temperature of the silica sand approaches approximately 550° C. From the above graph, it is noted that chromite and olivine do not undergo a similar abrupt expansion as does the silica sand.

The importance of the linear expansion is apparent when one compares the thermal diffusivity of a casting metal, such as an aluminum alloy, with that of sand. The thermal diffusivity of an aluminum alloy is approximately $6.2 \times 10^{-5}$ $m^2/s$ which is approximately 150 times greater than the thermal diffusivity of the sands as shown in Table I above. This means that the average distance through which heat flows in a given time is approximately 12 times greater for the aluminum alloy than for sand, resulting in a heat build up at the sand/metal interface which causes the sand mold cavity to expand. Since the thermal expansion coefficient of silica sand is approximately 4 times greater than that of chromite sand, any temperature increase at the metal/sand interface will cause the silica sand to expand substantially more than chromite sand and therefore will produce a larger dimensional casting. Also, since the molten metal/sand interface has moved outward before the start of solidification, the calculated shrinkage value obtained on the larger casting will result in an apparent lower (and unpredictable) shrinkage value for the solidified metal.

As noted above, the heat diffusivity of the sand is directly related to the solidification rate of the molten metal. From the heat diffusivity data shown in Table I above, it is seen that the use of chromite sand should increase the solidification rate of the metal, i.e. the time required to pass between the liquidus and solidus temperatures, over that using silica sand by approximately 26% to 56% due to the greater heat diffusivity of the chromite sand. This improvement in the solidification rate in itself may not be seen as a worthwhile economic advantage but when considered with the large expansion that occurs with silica sand at about 550° C., a substantial improvement in the precision of the castings is achieved.

When casting an engine block for an internal combustion engine, the pattern is formed with a plurality of cylindrical bores which correspond to the cylinders in the cast block. In the flask the sand not only surrounds the pattern, but also fills the bores thus providing sand cores. During casting, the molten metal will shrink as it solidifies. If the sand core does not "give" as the metal solidifies and shrinks around it, stresses can be set up in the casting and unpredictable diameters will be obtained in the cylinder bores. Thus, the sand used as the core should permit the core to follow the shrinkage of the solidifying metal.

The following Table summarizes repeat measurements of the average of twenty-five different critical dimensions of a complex 60 HP, three-cylinder, marine engine block using various sand molding materials in an expendable foam casting process and using the aluminum-silicon alloy of Example 3, above. The results show that when using chromite sand, silicon carbide sand, or carbon sand the shrinkage of the alloy has nearly matched the unconstricted contraction of the alloy as reported in the literature. This is quite surprising, because complex engine blocks with large cores and produced in a sand casting process using bonded sand, generally exhibit smaller contraction results than the unconstricted contraction of the alloy. The different contraction results in the alloy, as shown in Table II, are believed to be the result of different degrees of constraint by the sand mold (and core) during cooling. It is recognized that the hardness of ramming of the sand and the percentage of binder in chemically bonded sands significantly affects the contraction. Based on the above, the unbonded sand in the expendable foam casting process can be viewed as inherently offering less of a constraint during cooling than bonded sand and, therefore more sensitive to the phenomena of the expansion of the mold from molten metals of higher heat content and/or from starting the casting process with heated sand. This latter factor is clearly reflected by the shrinkage values in the alloy of 0.00925 inch per inch and 0,007 inch per inch for 80° F. and 160° F. silicon sand, respectively. The larger dimensioned cast engine blocks resulting from the use of heated silica sand simply reflect the larger expansion of the sand mold as a result of the higher sand temperature.

TABLE II

| Sand Type | Sand Temperature | Average Shrinkage (in/in) | Coefficient of Variation of Shrinkage |
|---|---|---|---|
| Silica | 160° F. | 0.0070 | 60% |
| Silica | 80° F. | 0.0093 | 50% |
| Chromite | 80° F. | 0.0119 | 35% |
| Silicon carbide | 80° F. | 0.0110 | 37% |
| Spherical Carbon sand | 80° F. | 0.0106 | 36% |

From the above table, it can be seen that the use of chromite sand, silicon carbide sand, and carbon sand, resulted in a greater metal shrinkage rate in inches per inch than when using silica sand thus enabling an unbonded sand core to more closely follow the shrinkage of the alloy.

Equally important is the fact that the use of chromite sand, silicon carbide sand and carbon sand produced a substantially lower coefficient of variation of shrinkage in the metal casting, as compared to the use of silica sand. This means that the shrinkage at the various locations of measurement was more uniform and had less variance than that measured when using silica sand.

Repeat measurements on a cast 250 HP, V-6, 3 liter, marine engine block gave similar results. The ambient temperature, 80° F. silica sand yielded a shrinkage value of 0.0094 inch per inch, and the ambient temperature chromite sand yielded a shrinkage of 0.0118 inch per inch. In addition, the ambient temperature silica sand gave a precision, reflected by the coefficient of variation (of shrinkage), more than 40% worse than that obtained through use of the chromite sand. These results further evidence that silica sand, as the molding material, produces larger dimensional engine blocks than the use of chromite sand. Moreover, the precision obtained with silica sand as the sand temperature increases is significantly less than the precision obtained with chromite sand. The test results also indicate that the geometry differences between a V-6 engine block and an in-line three-cylinder block do not materially affect the shrinkage values obtained for the two different sand types.

Figure 3A:
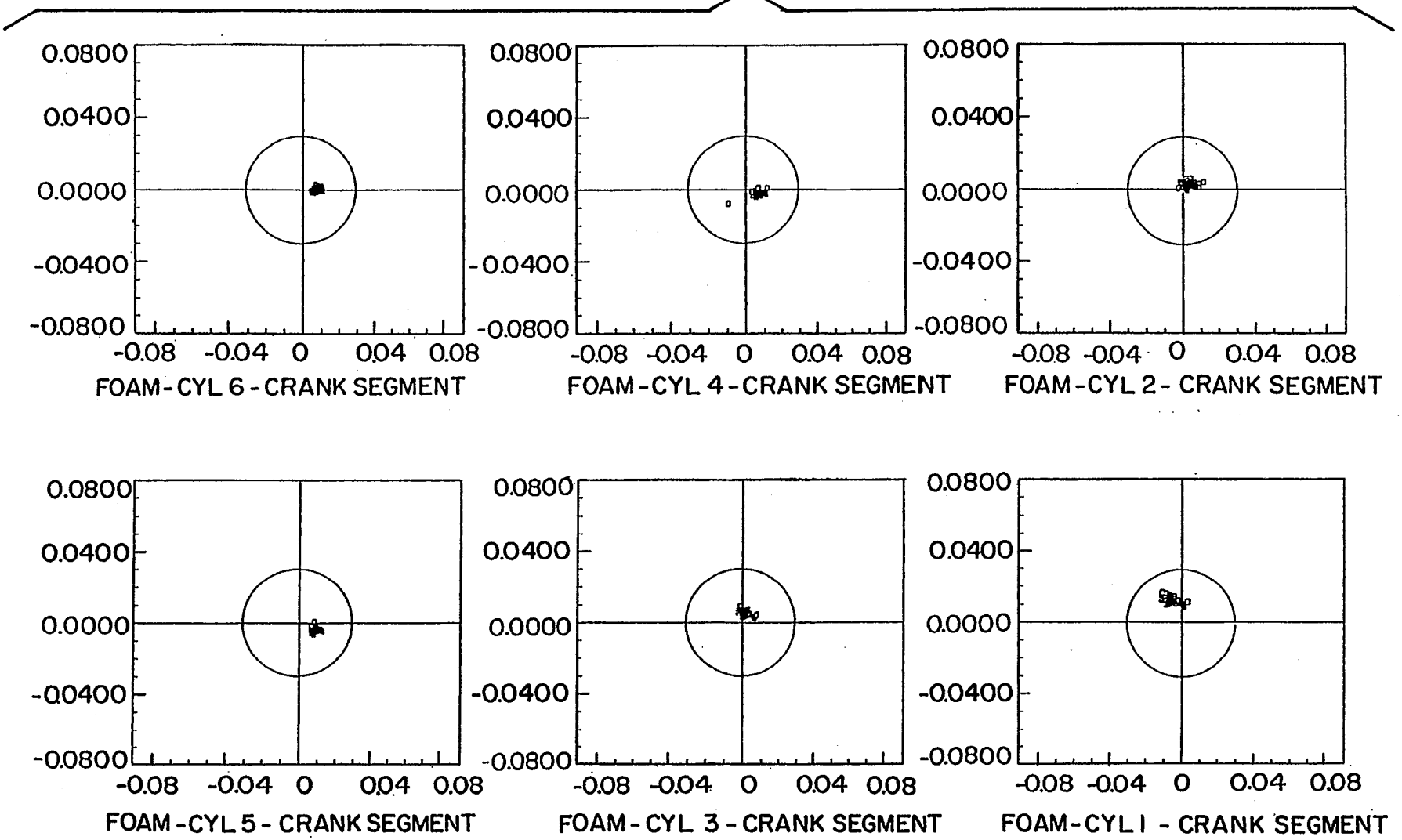
FIG. 3A comprises a group of charts showing the center line positions of cylinder bores of a plurality of expendable foam patterns to be used in casting a V-6 engine block, with the measurements being taken at the crank segment end of each cylinder bore.

FIGS. 3A–6C illustrate the improvement in dimensional predictability or stability that is achieved in an expendable foam casting process utilizing sand having the physical properties as outlined above. FIGS. 3A–3C show measurements taken of the center lines of the bores of one hundred and thirty-three polystyrene glued patterns to be used in casting V-6 engine blocks. The patterns were produced by injection molding using metal dies. Each chart represents the positions or measurements of the center lines of the cylinder bores for the six cylinders. The circle at the center of each chart represents the specified tolerance of 0.031 inch. More specifically, FIG. 3A shows the positions of the center lines in the crank end foam segment of the six cylinder bores. FIG. 3B is similar to FIG. 3A showing the center line positions of the cylinder bores of the foam patterns taken at the longitudinal center segment of the bores, while FIG. 3C show the center line measurements taken at the dome segment end of the cylinder bores of the foam patterns. Alignment and congruence of the center line positions for the three glued up foam segments is of paramount importance.

Figure 3B:
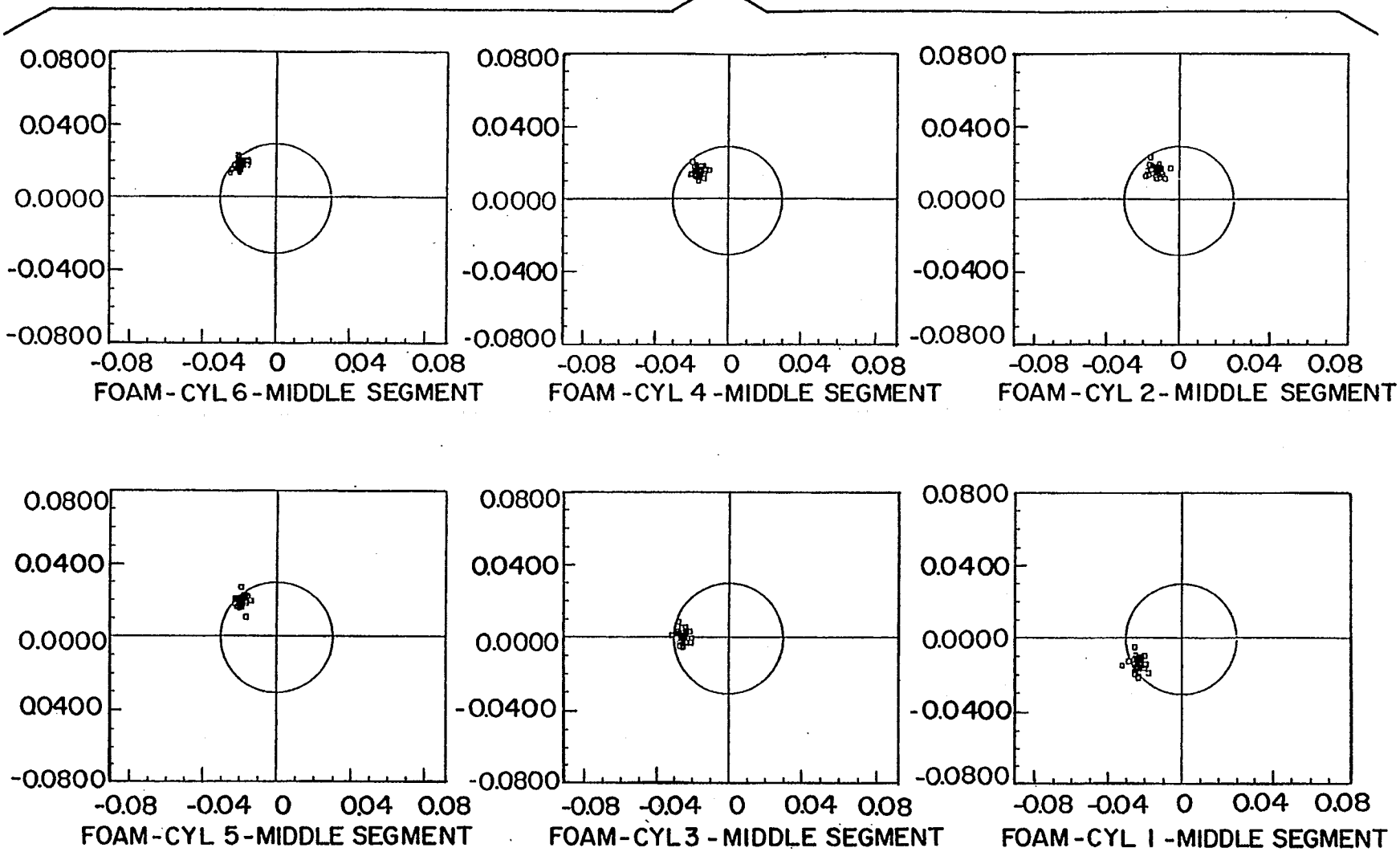
FIG. 3B comprises a series of charts similar to FIG. 3A, showing the center line positions of the cylinder bores at the longitudinal center segment of the cylinder bores.
Figure 3C:
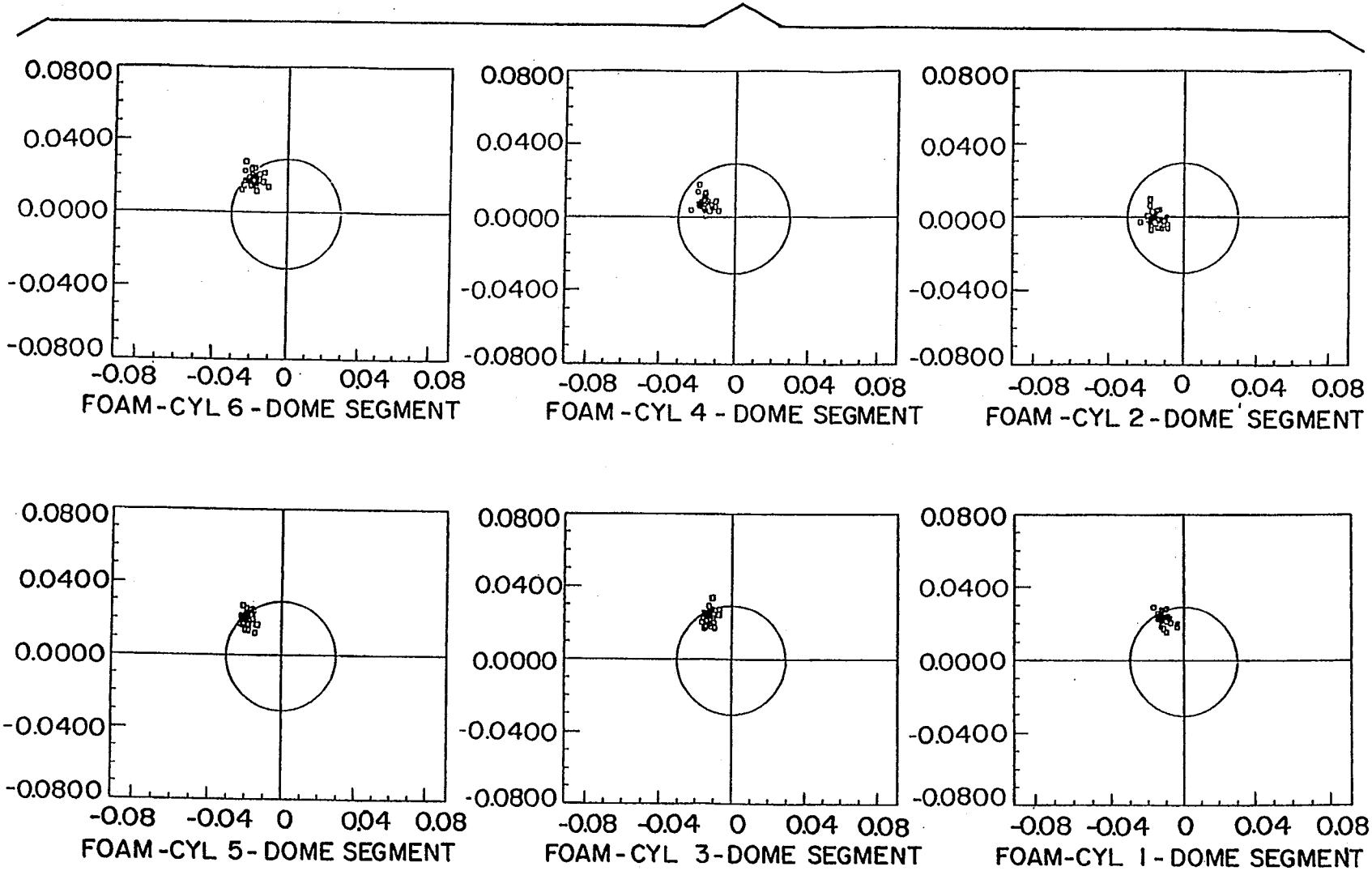
FIG. 3C is a series of charts similar to FIG. 3A showing the center line positions at the dome segment end of the cylinder bores.

It can be seen from FIGS. 3A–3C that the center lines for all of the cylinder bores in the foam patterns are clustered very tightly within the tolerance circle or target. Thus, the batch of glued up foam patterns covered by this data was shown to be dimensionally stable with the center lines of the cylinder bores for virtually all patterns falling within the tolerance limits.

Figure 4A:
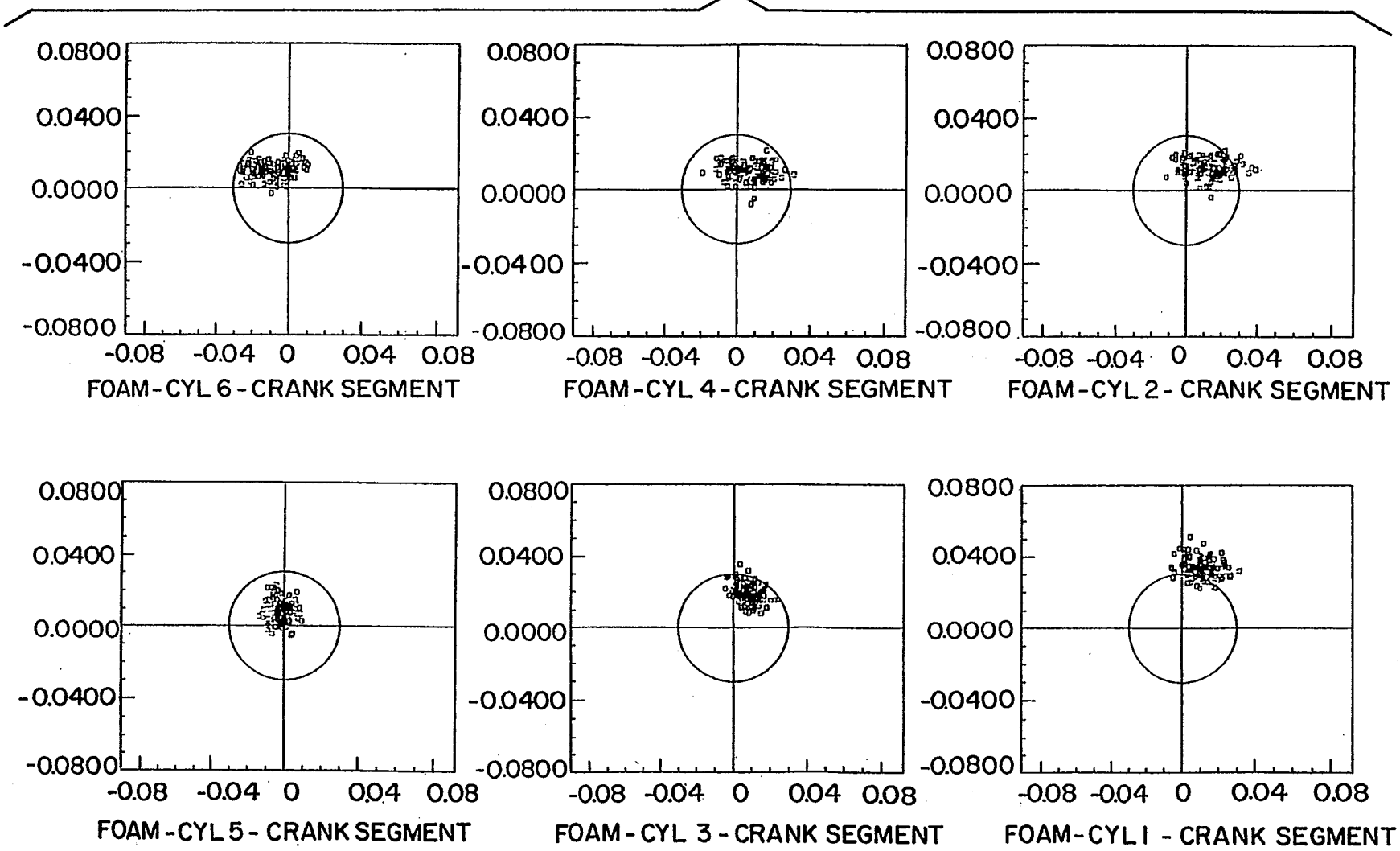
FIG. 4A comprises a series of charts showing the center line positions of the cylinder bores of a plurality of cast V-6 engine blocks produced through use of expendable foam patterns and silica sand at a temperature of 80° F., with the measurements taken at the crank end of the cylinder bores.
Figure 4B:
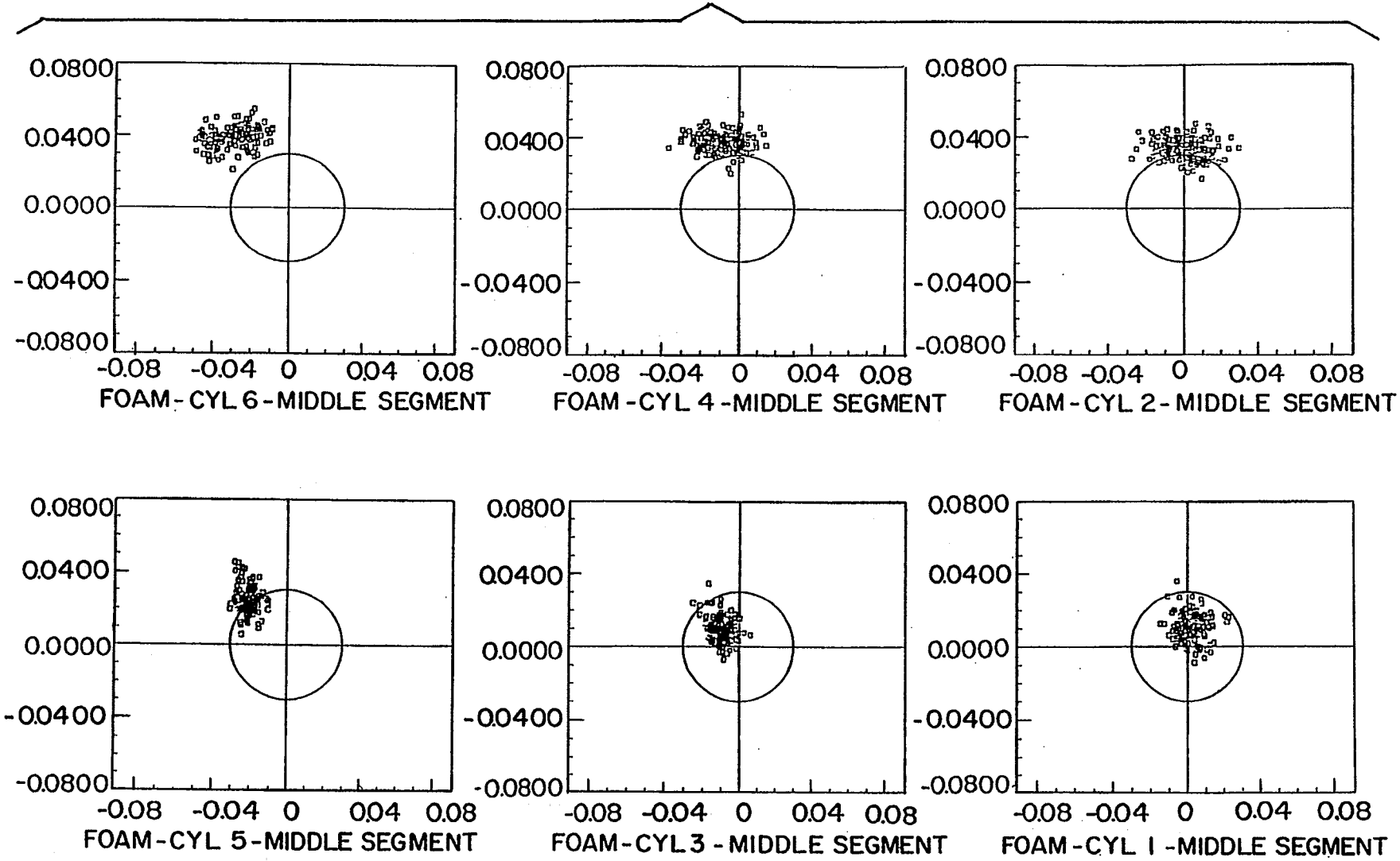
FIG. 4B comprises a series of charts similar to FIG. 4A with the measurements being taken at the longitudinal center segment of the cylinder bores.
Figure 4C:
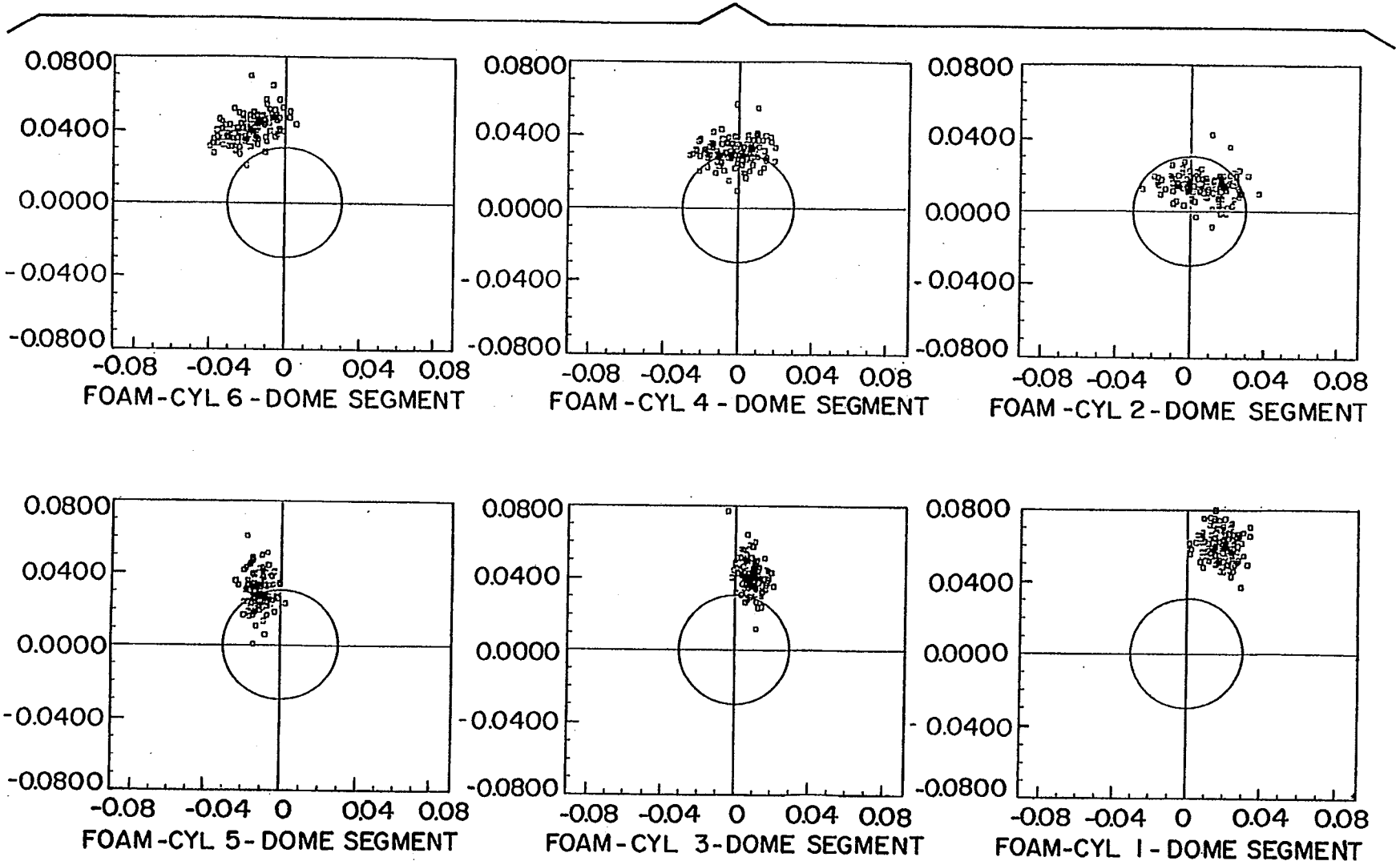
FIG. 4C comprises a series of charts similar to FIG. 4A with the measurements being taken at the dome segment end of the cylinder bores.

The charts of FIGS. 4A–4C show the center line positions of the cylinder bores of one hundred and eleven cast engine blocks. In the data of FIGS. 4A–4C, foam patterns of the batch tested in FIGS. 3A–3C were used and each foam pattern was surrounded in the flask by unbonded silica sand at a temperature of 80° F. The silica sand has an AFS grain fineness of 31, and an AFS base permeability number of 475. Aluminum alloy 356 was used as the casting metal.

FIG. 4A shows the center line positions of the cylinder bores of the cast engine blocks at the crank end, while FIG. 4B shows the center line positions at the longitudinal center segment of the cylinder bores, while FIG. 4C shows the center line positions at the dome segment ends of the cylinder bores.

As seen in FIGS. 4A–4C, the center line positions are widely scattered, well outside of the target circle, thereby resulting in engine blocks that cannot be adequately machined and exhibit a lack of clean up after the cylinder bore machining operation. Thus, the majority of the cast engine blocks produced through use of silica sand, as shown in FIGS. 4A–4C have cylinder bores that are outside of the specified tolerance, and cannot be adequately machined.

Figure 5A:
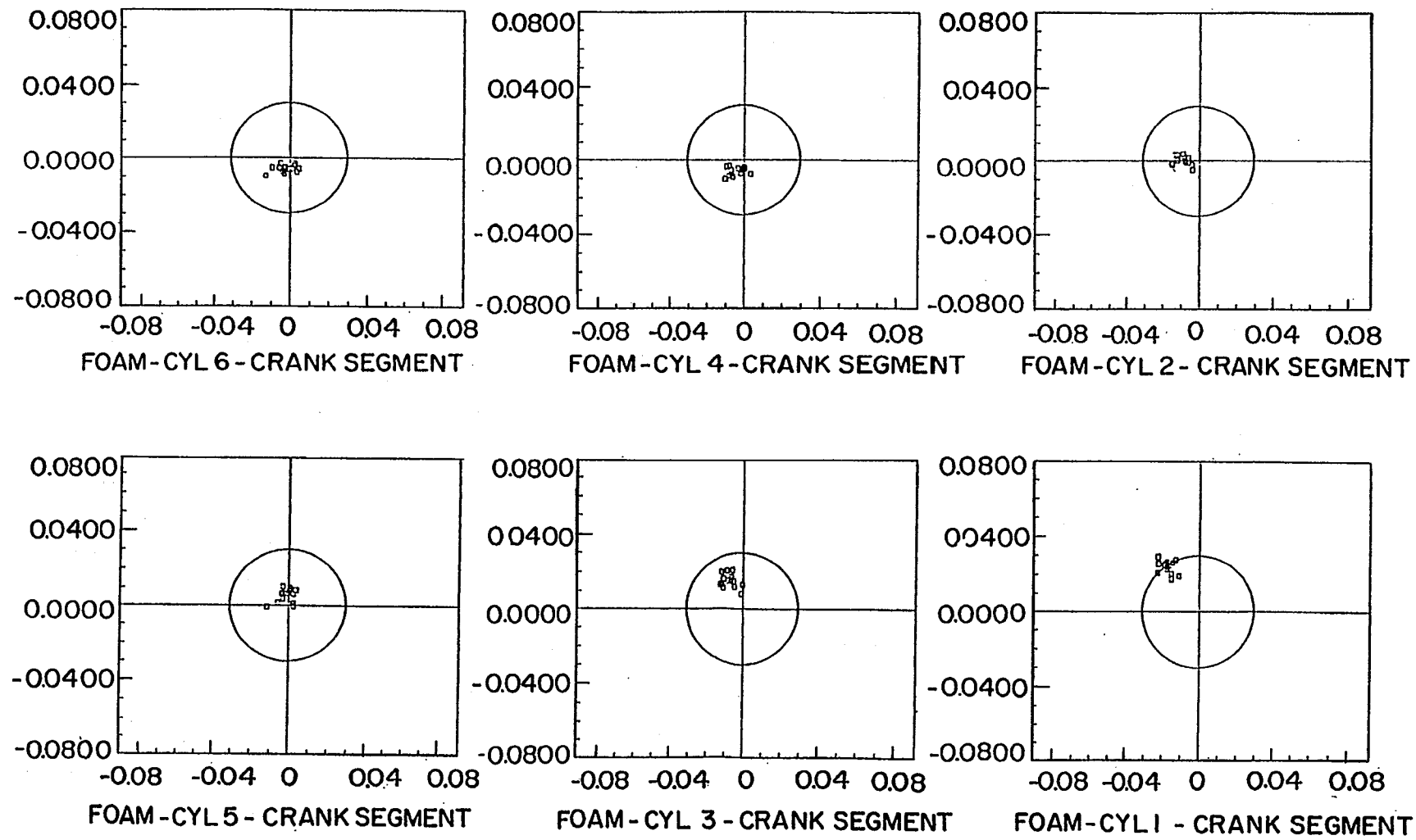
FIG. 5A comprises a series of charts showing the center line positions of the cylinder bores of a plurality of cast V-6 engine blocks produced through use of expandable foam patterns and carbon sand at 80° F. with the measurements taken at the crank segment end of the cylinder bores.
Figure 5B:
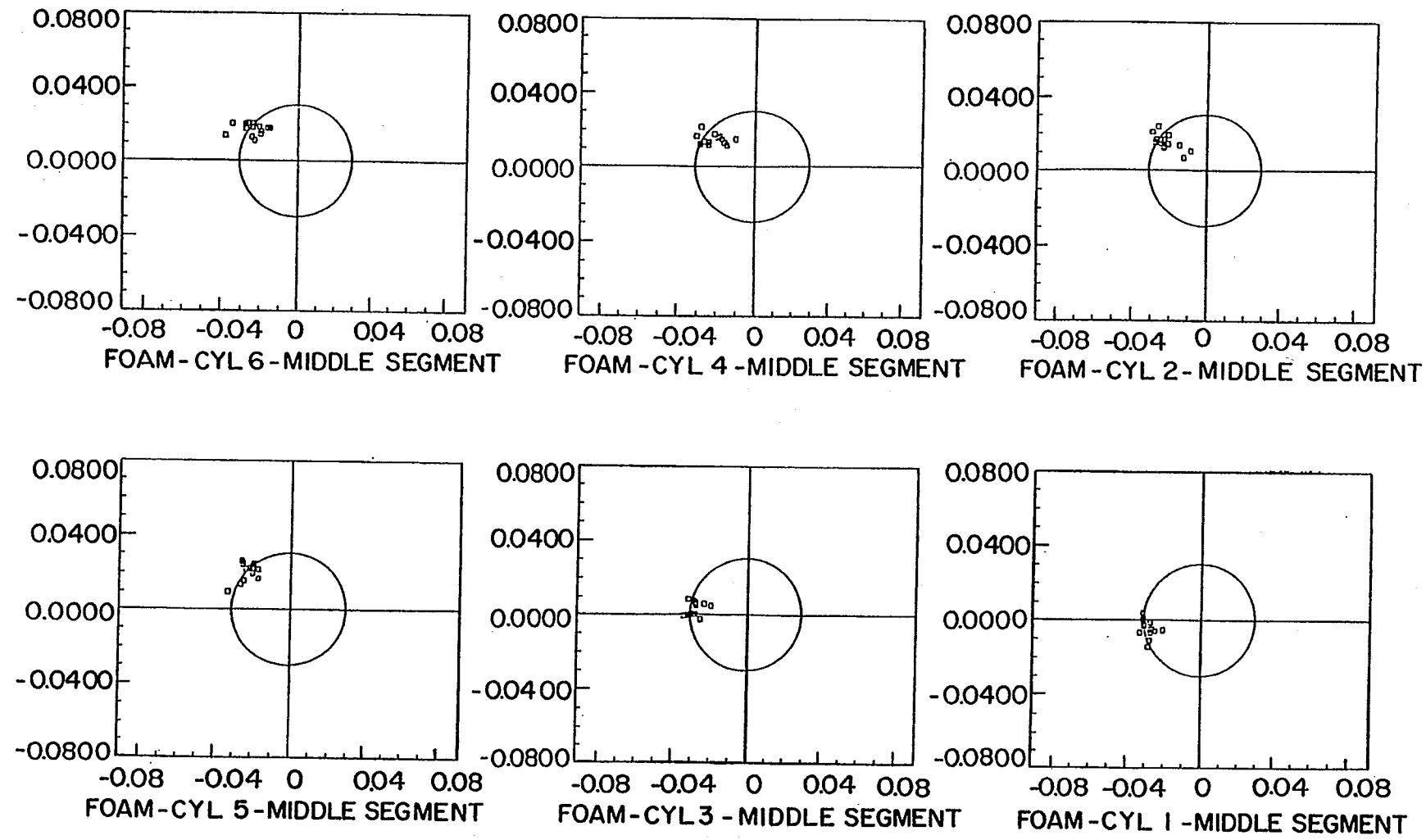
FIG. 5B comprises a series of charts similar to FIG. 5A with the measurements taken at the longitudinal center segment of the cylinder bores.
Figure 5C:
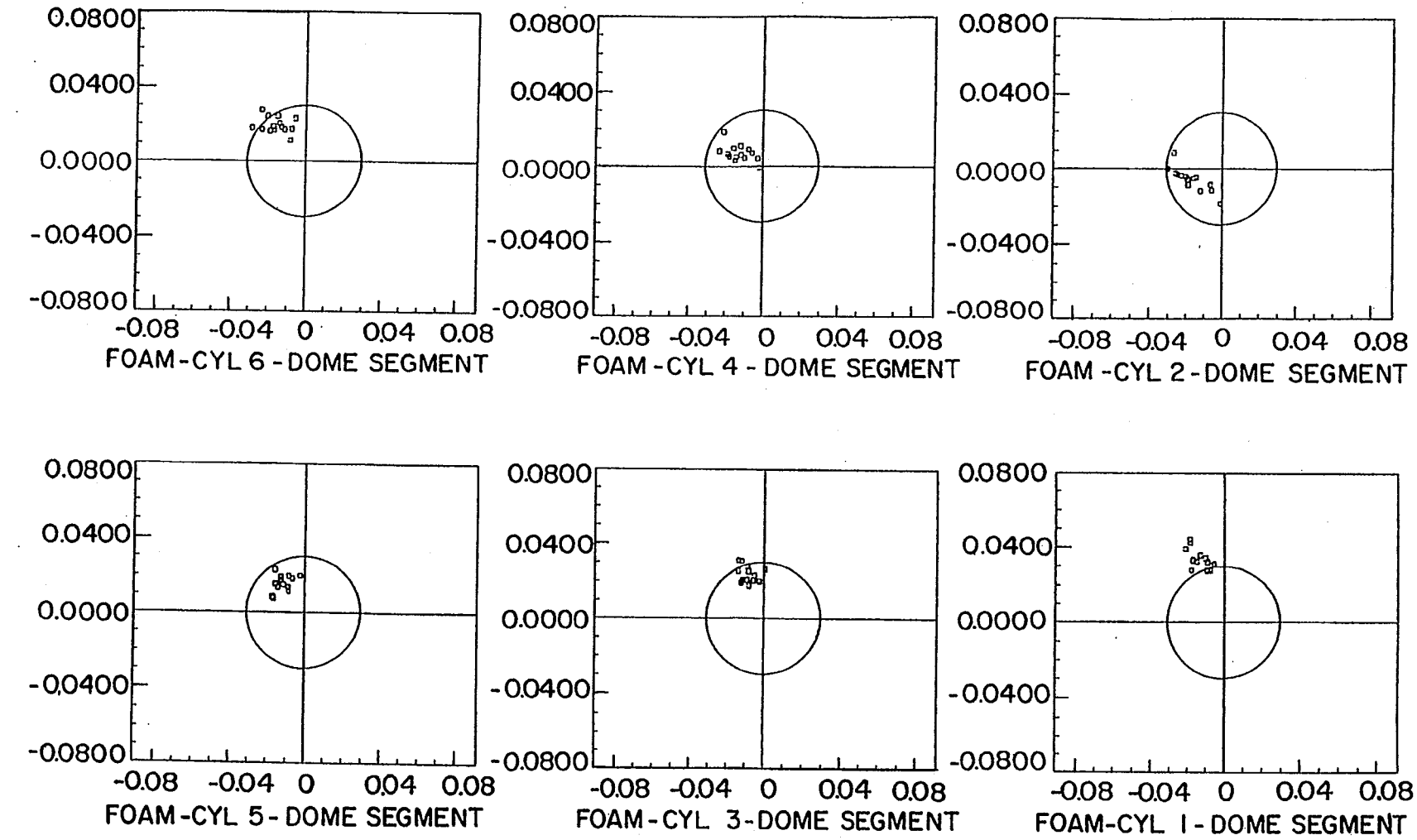
FIG. 5C comprises a series of charts similar to FIG. 5A with the measurements taken at the dome segment ends of the cylinder bores.

FIGS. 5A–5C show the results of similar testing on a series of fourteen V-6 engine blocks produced by expendable foam casting and using carbon sand at 80° F. The carbon sand had an AFS grain fineness of 33, and an AFS base permeability number of 450. As in the case of the data shown in FIGS. 4A–4C, foam patterns of the batch tested in FIGS. 3A–3C were employed, and the engine blocks were cast from an aluminum alloy 356 was used as the casting alloy.

FIG. 5A shows the center line positions of the cast cylinder bores at the crank segment end, FIG. 5B shows the center line positions at the longitudinal center segment of the cylinder bores, and FIG. 5C shows the center line positions at the dome segment end of the cylinder bores of the blocks.

Figure 6A:
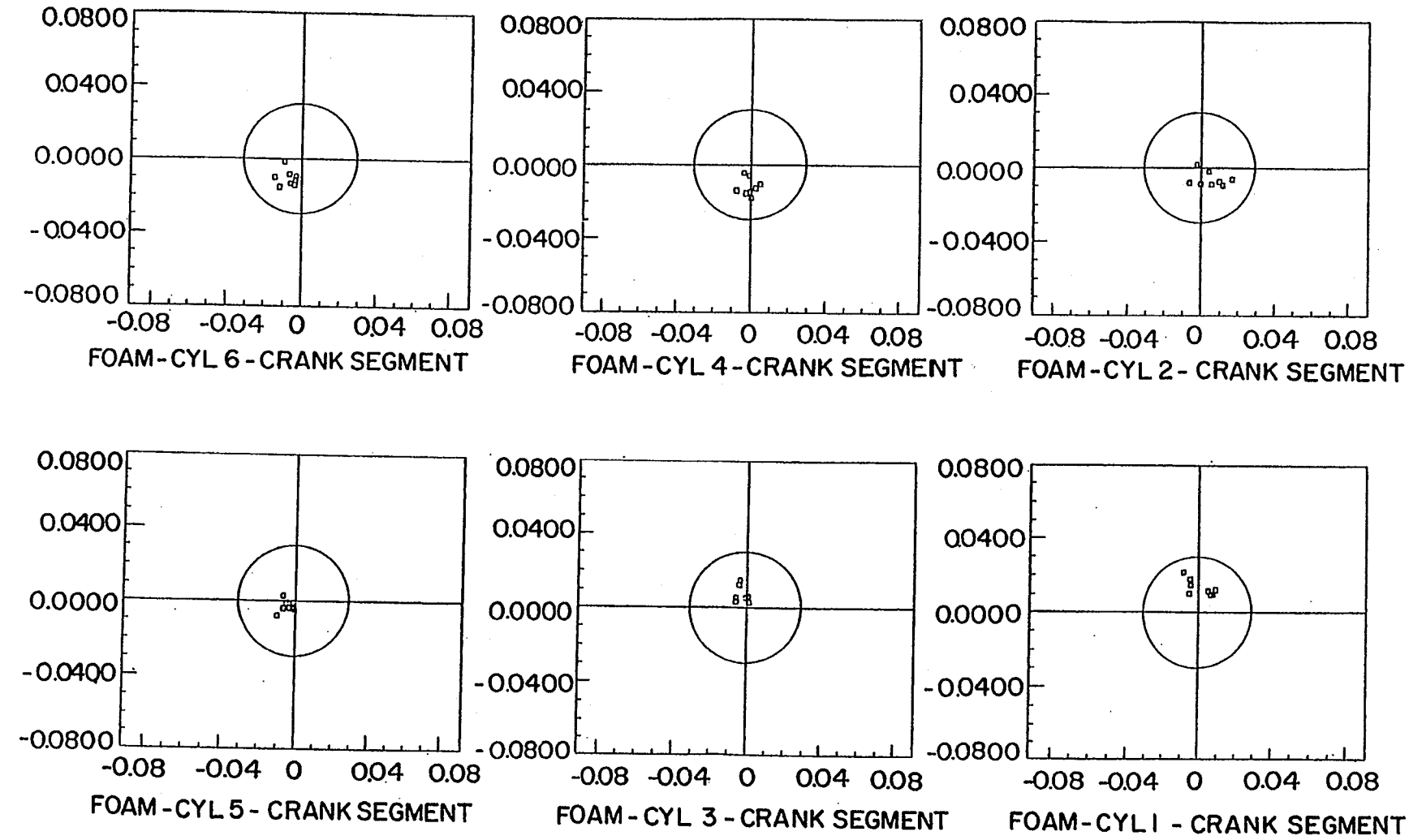
FIG. 6A comprises a series of charts showing the center line positions of the cylinder bores of a series of cast V-6 engine blocks produced through use of expendable foam patterns and carbon sand at 130° F., with the measurements being taken at the crank segment ends of the cylinder bores.
Figure 6B:
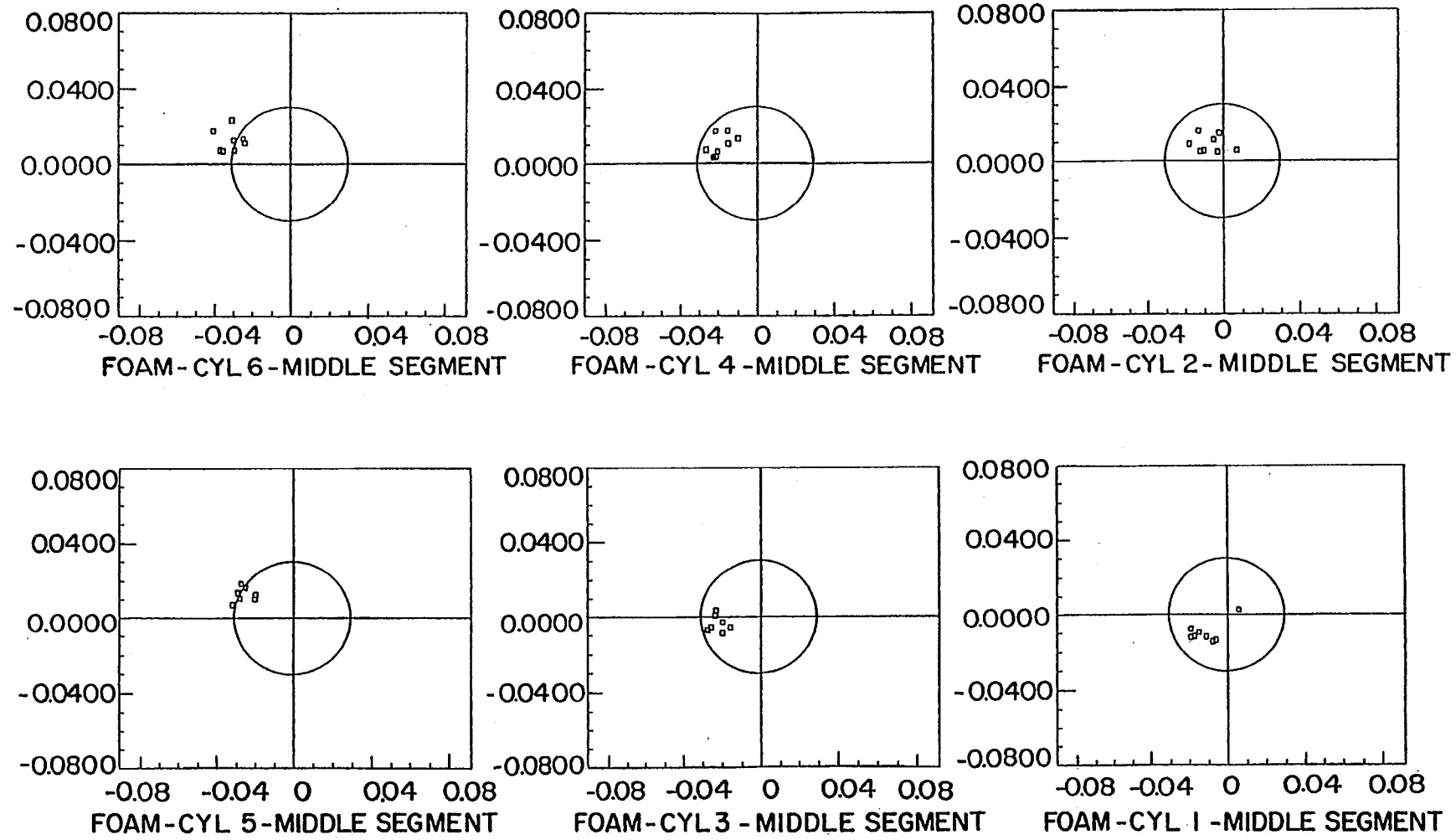
FIG. 6B comprises a series of charts similar to FIG. 6A with the measurements taken at the longitudinal center segment of the cylinder bores.
Figure 6C:
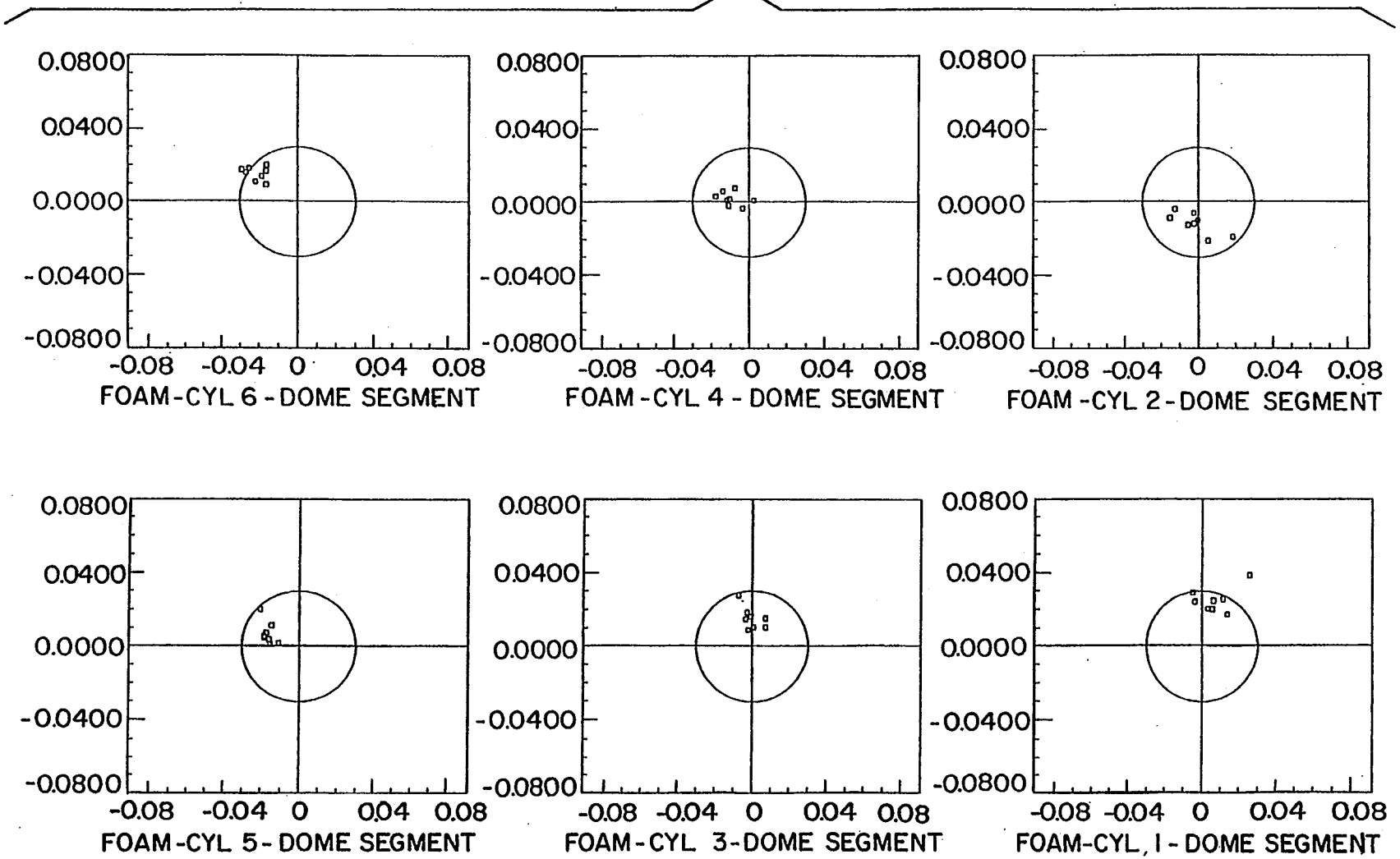
FIG. 6C comprises a series of charts similar to FIG. 6A with the measurements taken at the dome segment ends of the cylinder bores.

FIGS. 6A–6C show the center line positions of cylinder bores of cast engine blocks using a casting procedure the same as that of FIGS. 5A–5C, except that the carbon sand was at a temperature of 130° F.

When the data shown in FIGS. 5A–5C and 6A–6C is compared with the true positions of the center lines of the bores for the foam patterns, as shown in FIGS. 3A–4C, it indicates that the center line positions of the foam patterns and those of the resulting castings can almost be superimposed on one another, indicating excellent dimensional predictability from part-to-part. Moreover, the scatter of the center line measurements of the engine blocks of FIGS. 5A–5C and 6A–6C are only a fraction of the scatter of the center line measurements shown in FIGS. 4A–4C using silica sand. Further, the data for the higher temperature carbon sand, FIGS. 6A–6C, and the lower temperature carbon sand, FIGS. 5A–5C, does not show a large difference in scatter or precision.

This data conclusively shows that the use of sand having the specified physical properties as outlined above, produces more precise and predictable castings in an expendable foam casting process than those obtained in a similar process using silica sand.

It has also been found that the leak tightness of cast engine blocks produced by a conventional expendable foam casting process using silica sand differs with the sand temperature. As an example, the leak rate for an in-line three cylinder engine aluminum block produced in an expendable foam casting process using low temperature silica sand at 80° F. is three times that observed when using higher temperature silica sand at 130° F. However, it has been found that silica sand at 130° F. cannot be successfully used in casting either an in-line three cylinder block or a V-6 block, because heated sand will produce a larger dimension casting, which is unacceptable. Thus, in practice, silica sand at a temperature of about 80° F. has been used in commercial manufacturing processes. Because of the increased leak rate with low temperature silica sand, it has therefore been necessary to impregnate the cast block, sometimes as many as three times, with a sealer, such as Loctite to enable the cast block to pass the leak tightness requirements. In contrast to this, the invention utilizing a sand temperature of 120° F. or above and having the above-mentioned physical properties produces leak-tight engine blocks either in the in-line three cylinder design, or in the V-6 design and both designs are dimensionally predictable without instances of a lack of clean-up in any of the bores after machining.

As a further advantage, the method of the invention enables more complicated castings to be produced as an integral part. For example, when casting a V-6 engine block, the exhaust manifold with its divider plate and cover plate can be cast as an integral part of the cast engine block, thus reducing the overall manufacturing cost. To obtain the same dimensional stability as achieved by the invention, a V-6 engine block would have to be made in a casting process using precision bonded sand, and in such a process the engine block would be cast separately from the manifold exhaust divider plate and cover, thus, requiring the additional expense of separate tooling for the divider plate and cover.

Not only are the thermal properties of the sand important in providing precision castings, but it has also been found that the temperature of the sand influences the casting. For example, in winter conditions in the foundry, the sand temperature may be in the range of 18.3° C. (65° F.) to 29.4° C. (85° F.). In summer, where the ambient temperature may be up to 32.2° C. (90° F.) or higher, the sand temperature can be in the range of 29.4° C. (85° F.) to 40.5° C. (105° F.). With the higher sand temperature in summer, the castings will have a somewhat larger dimension than castings produced in the winter with the sand at a lower temperature. Therefore, to compensate for this differential in dimensions in the cast part, the size of the expendable foam patterns can be adjusted. The dimension of the pattern can be changed by aging the plastic beads before molding, or by aging the molded parts after molding, or by selecting another foam bead type. Thus, by proper aging or selection of the beads, a larger pattern can be obtained which can be used in the winter to compensate for the lower sand temperature, thus resulting in cast parts which have the same dimensions regardless of the ambient seasonal temperature of the sand.

Figure 2:
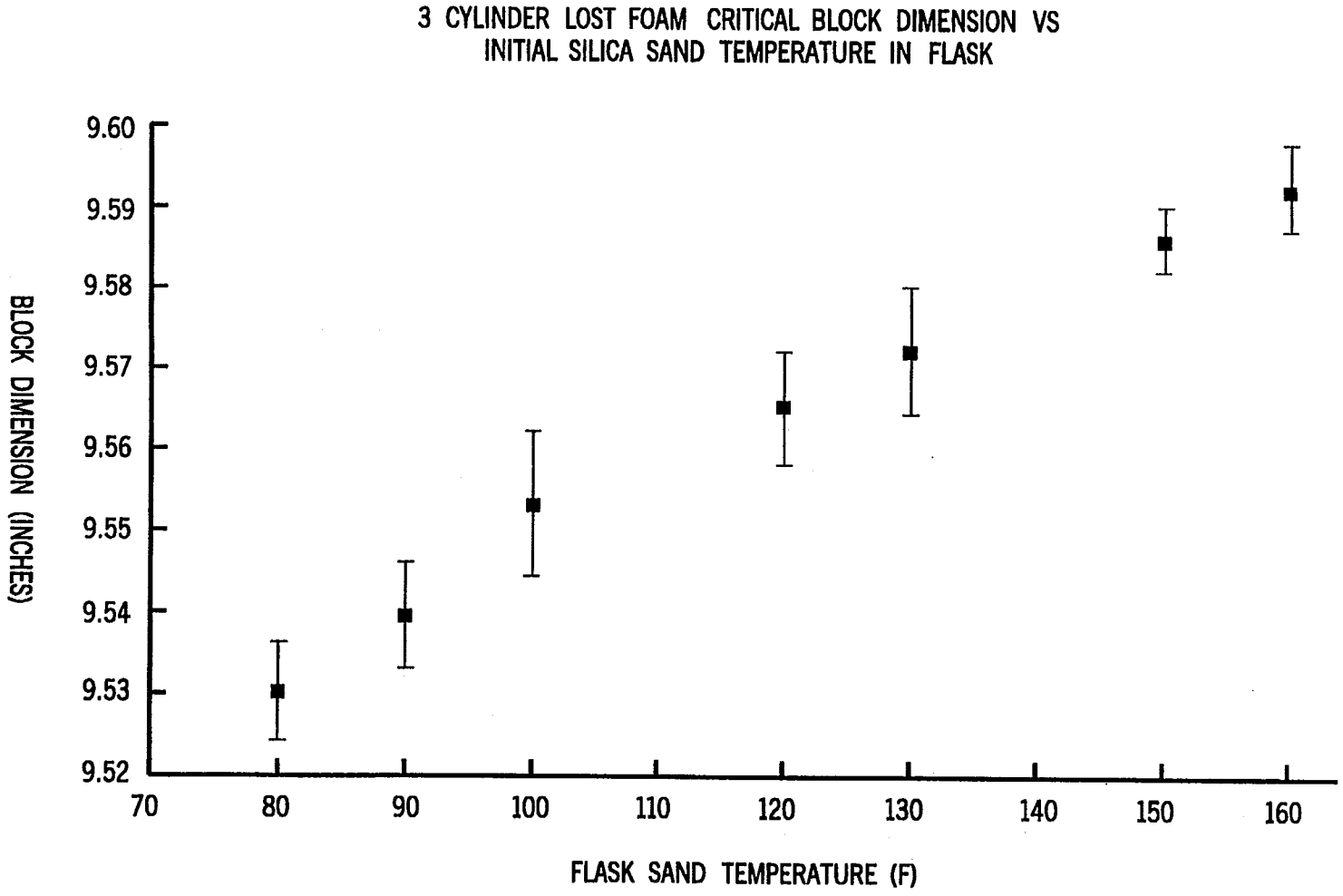
FIG. 2 is a graph showing the variation in dimensions of a three cylinder engine block when using silica sand at different temperatures.

FIG. 2 further illustrates the importance of the sand temperature on the precision of casting. FIG. 2 is a curve showing average measurements of an engine block dimension in inches as a function of the temperature of unbonded silica sand used in an expendable pattern casting process. The engine block was cast from a hypoeutectic aluminum-silicon alloy having the composition of Example 3 above. As seen in FIG. 2, the average engine block dimension when using sand at ambient temperature of 80° F. was 9.53 inches. As the sand temperature was increased to 160° F., the average block dimension also increased to a value of about 9.59 inches, or an increase of 0.06 inch.

While the above curve shows the difference in dimensions obtained by using silica sand at various temperatures, similar expansion results, although smaller by a factor of approximately four, are obtained using chromite sand, silicon carbide sand, or carbon sand, thus indicating that sand temperature is a factor in obtaining precisely dimensioned castings.

Also important is the control of the sand temperature within a specified range from cast part-to-cast part. To obtain dimensional precision the temperature of the sand should be maintained within a specific range when casting a group or number of parts. For example, when casting engine blocks, the temperature of the sand for each cast should be maintained within a value of ±10° F., while for other articles the sand should be maintained for each cast within a range of ±20° F.

During casting the temperature of the sand will usually be increased to a value of about 200° F., and the sand is then sent to a cooler, and the flow of the sand through the cooler is controlled to maintain the sand within the above specified range for the next casting operation.

The invention is based on the discovery that more precise castings can be produced in an expendable pattern casting process by utilizing sand having specific physical and thermal properties and controlling the sand temperature or correlating the sand temperature with the pattern size.

Various modes of carrying out the invention are contemplated as being within the scope of the following claims particularly pointing out and distinctly claiming the subject matter which is regarded as the invention.

We claim:

1. A method of producing dimensionally predictable metal castings, comprising the steps of forming a pattern of an expendable foam polymeric material having a configuration corresponding to an article to be cast, positioning the pattern in spaced relation to an outer flask, disposing a first quantity of an unbonded sand in the flask surrounding the pattern, said sand having a diffusivity greater than 1500 $J/m^2/°K/s^{\frac{1}{2}}$, a linear expansion from 0° C. to 1600° C. of less than 1%, an AFS grain fineness number of 25 to 33, and an AFS base permeability number of 450 to 500, contacting the pattern with a molten metal to decompose the polymeric material with the products of decomposition being entrapped within the interstices of the sand, solidifying the molten metal to produce a cast article, and removing the cast article from the flask.

2. The method of claim 1, and including the steps of forming a second pattern having a configuration corresponding to said article and positioning said second pattern in a second flask, disposing a second quantity of sand in the second flask and surrounding said second pattern, maintaining the temperature of said second quantity of sand within ±20° F. of the temperature of the first quantity of said sand, and contacting the second pattern with a molten metal and solidifying said molten metal to produce a second cast article.

3. The method of claim 2, and including the step of maintain the temperature of both the first quantity and the second quantity of sand in the range of 100° F. to 120° F.

4. The method of claim 1, wherein the polymeric material is selected from the group consisting of polystyrene and polymethylmethacrylate.

5. The method of claim 1, wherein the sand is selected from the group consisting of chromite sand, silicon carbide sand, olivine sand, carbon sand, and mixtures thereof.

6. The method of claim 1, wherein the step of contacting the pattern with a molten metal comprises contacting the pattern with a hypereutectic aluminum silicon alloy containing more than 12% silicon.

7. The method of claim 1, wherein the step of contacting the pattern with a molten metal comprises contacting the pattern with a ferrous metal.

8. The method of claim 1, wherein said sand has a linear expansion from 0° C. to 700° C. of less than 0.75%.

9. A method of producing dimensionally predictable engine blocks for an internal combustion engine, comprising the steps of forming a pattern of an expendable foam polymeric material having a configuration corresponding to an engine block to be cast and containing at least one cylindrical bore, positioning the pattern in spaced relation to an outer flask, disposing an unbonded sand in the flask surrounding the pattern and within the bore, said sand having a heat diffusivity greater than 1500 $J/m^{2/}°K/s^{\frac{1}{2}}$, a linear expansion from 0° C. to 1600° C. of less than 1%, an AFS grain fineness number of 25 to 33, and an AFS base permeability number of 450 to 500, contacting the pattern with a molten metal to decompose the polymeric material with the products of decomposition being entrapped within the interstices of the sand, solidifying the molten metal to produce a cast engine block containing at least one cylinder bore, removing the block from the flask, and thereafter machining the cylinder bore.

10. The method of claim 9, wherein the molten metal is an aluminum alloy.

* * * * *